US008985571B2

(12) United States Patent
Ueda et al.

(10) Patent No.: US 8,985,571 B2
(45) Date of Patent: Mar. 24, 2015

(54) SHEET FEEDING APPARATUS AND IMAGE FORMING APPARATUS

(75) Inventors: Shinichi Ueda, Mishima (JP); Shuji Nishitani, Numazu (JP); Masato Tanabe, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 214 days.

(21) Appl. No.: 13/291,381

(22) Filed: Nov. 8, 2011

(65) Prior Publication Data

US 2012/0119434 A1 May 17, 2012

(30) Foreign Application Priority Data

Nov. 15, 2010 (JP) ..... 2010-254483

(51) Int. Cl.
*B65H 1/00* (2006.01)
*B65H 1/04* (2006.01)

(52) U.S. Cl.
CPC ..... *B65H 1/04* (2013.01); *B65H 2301/4222* (2013.01); *B65H 2405/114* (2013.01); *B65H 2405/15* (2013.01); *B65H 2405/32* (2013.01); *B65H 2801/06* (2013.01)
USPC ..... 271/171; 271/241; 271/248

(58) Field of Classification Search
USPC ..... 271/171, 241, 248, 221–223
See application file for complete search history.

(56) References Cited

U.S. PATENT DOCUMENTS 4,030,725 A * 6/1977 Fukui et al. ..... 271/164
4,657,239 A * 4/1987 Ikesue et al. ..... 271/227
5,118,920 A 6/1992 Tanabe et al.
5,292,116 A * 3/1994 Inoue et al. ..... 271/157
5,292,117 A * 3/1994 Takagi et al. ..... 271/234
5,398,108 A 3/1995 Morinaga et al.
5,956,471 A 9/1999 Ueda et al.
5,963,755 A 10/1999 Ueda et al.
7,331,577 B2 2/2008 Park (Continued)

FOREIGN PATENT DOCUMENTS

EP 0 503 573 A2 9/1992
EP 0 503 573 B1 9/1992

(Continued)

OTHER PUBLICATIONS

Combined Search and Examination Report, dated Mar. 1, 2012, issued by the Intellectual Property Office, in Great Britain Application No. 1119307.5.

(Continued)

*Primary Examiner* — Prasad Gokhale
(74) *Attorney, Agent, or Firm* — Fitzpatrick, Cella, Harper & Scinto

(57) ABSTRACT

A sheet feeding apparatus that can prevent changes at the time of mounting a sheet cassette, and deformation and changes of the sheets after the sheet cassette is mounted regardless of a sheet size are provided. A movable side regulating plate provided in a frame, regulates positions of width direction side ends of sheets is provided with sheet pressing portions and that press the side ends of the sheets to press the sheets against a fixed side regulating plate in a biasing manner. An indented configuration against which, when short sheets are pressed by the sheet pressing portion are stacked on a sheet stacking plate, upstream ends of the sheets do not abut is formed upward from a bottom end of the sheet pressing portion to a predetermined dimension at a sheet feeding direction center of the sheet pressing portion.

18 Claims, 13 Drawing Sheets

(56) References Cited

U.S. PATENT DOCUMENTS

| | | | | |
|---|---|---|---|---|
| 7,979,002 | B2 | 7/2011 | Nishikata et al. | |
| 8,185,037 | B2 | 5/2012 | Kimijima | |
| 2003/0193130 | A1 | 10/2003 | Park | |
| 2010/0061785 | A1* | 3/2010 | Kimijima | 399/388 |
| 2010/0133743 | A1* | 6/2010 | Hamasaki et al. | 271/241 |
| 2011/0024978 | A1 | 2/2011 | Nishikata et al. | |
| 2011/0227274 | A1 | 9/2011 | Nishikata et al. | |
| 2011/0272879 | A1* | 11/2011 | Ushiyama et al. | 271/227 |
| 2012/0061908 | A1* | 3/2012 | Ueda et al. | 271/162 |

FOREIGN PATENT DOCUMENTS

| | | | | |
|---|---|---|---|---|
| EP | 0 503 573 | A3 | 1/1993 | |
| EP | 638495 | A2 | 2/1995 | |
| EP | 638495 | B1 | 1/1998 | |
| EP | 1 352 860 | A2 | 10/2003 | |
| EP | 1 352 860 | B1 | 10/2003 | |
| EP | 1 352 860 | A3 | 7/2004 | |
| JP | 62-121142 | A | 6/1987 | |
| JP | 1-209227 | A | 8/1989 | |
| JP | 3-297746 | A | 12/1991 | |
| JP | 04144840 | A * | 5/1992 | B65H 1/04 |
| JP | 0583454 | B2 | 11/1993 | |
| JP | 6-298380 | A | 10/1994 | |
| JP | 07-196177 | A | 8/1995 | |
| JP | 7-309455 | A | 11/1995 | |
| JP | 8-295421 | A | 11/1996 | |
| JP | 9-183522 | A | 7/1997 | |
| JP | 2797629 | B2 | 9/1998 | |
| JP | 10-329957 | A | 12/1998 | |
| JP | 2000-118730 | | 4/2000 | |
| JP | 2000-128363 | A | 5/2000 | |
| JP | 2000-219330 | | 8/2000 | |
| JP | 2000-219330 | A | 8/2000 | |
| JP | 2002-037462 | A | 2/2002 | |
| JP | 3285249 | B2 | 5/2002 | |
| JP | 2002-255359 | A | 9/2002 | |
| JP | 2010-058967 | A | 3/2010 | |
| JP | 5123116 | B2 | 1/2013 | |

OTHER PUBLICATIONS

Office Action in Chinese Application No. 201110352762.4 dated Feb. 17, 2014.

Japanese Office Action issued in Corresponding Japanese Application No. 2010-254483 dated Aug. 7, 2014.

* cited by examiner

SHEET FEEDING APPARATUS AND IMAGE FORMING APPARATUS

BACKGROUND OF THE INVENTION

1. Field of the Invention

The present invention relates to a sheet feeding apparatus and an image forming apparatus and in particular to a configuration of a side end regulating portion which regulates positions of side ends of sheets accommodated in a sheet cassette detachably mounted on the sheet feeding apparatus.

2. Description of the Related Art

Today, in widely-used image forming apparatuses including a copying machine, a printer, and a facsimile, sheets are fed to an image forming portion by a sheet feeding apparatus to form images. According to such a sheet feeding apparatus, a sheet cassette is usually detachably mounted on an apparatus main body and sheets accommodated in the sheet cassette are automatically fed to the image forming portion.

According to a sheet cassette used for such a sheet feeding apparatus, for example, a middle plate on which sheets are stacked and which presses the sheets against a feed roller is provided so as to be movable upward and downward. Further, in a sheet cassette with such a middle plate, a rear end regulating portion which regulates positions of side ends of sheets on upstream (hereinafter, rear ends) in a sheet feeding direction accommodated on the middle plate in a stacked manner is slidably provided so that sheets of different sizes can be accommodated. Further, a pair of side end regulating portions which regulates positions of side ends of sheets in a direction perpendicular to a sheet feeding direction (hereinafter, a width direction) is also provided.

The pair of side end regulating portions regulates the side end of a sheet and the rear end regulating member regulates the rear end of the sheet, so that the position of the sheet is always at a predetermined position. Consequently, when the sheet cassette is accommodated in the apparatus main body, sheets are stably fed regardless of a sheet size.

According to a sheet cassette with such a side end regulating portion, one of side end regulating portions is fixed and the other can slide in the width direction. The one fixed side end regulating portion (hereinafter, fixed side end regulating portion) serves as a reference surface in the width direction of a sheet. Sheets are fed along the fixed side end regulating portion, so that predetermined printing precision is accomplished.

According to such a sheet cassette, when a direction of mounting/detaching the sheet cassette is the width direction, at the time when the sheet cassette is set, sheets are sometimes shifted because of an inertial force to be separated from the fixed side end regulating portion. Conventionally, among a pair of side end regulating portions, a slidable side end regulating portion (hereinafter, movable side end regulating portion) is provided with a sheet pressing portion to which a force is applied by a biasing unit such as a spring for pressing sheets. When sheets are shifted, this sheet pressing portion presses the shifted sheets back to the fixed side end regulating portion.

External dimensions of sheets vary. For example, when the tolerance of a width direction dimension of a sheet is ±2 mm, the position where the sheet pressing portion protrudes must be in the range of ±2 mm at minimum with respect to the position of a width direction end of a normal sheet. Accordingly, the position of the movable side end regulating portion at the time of regulating the side end of a sheet must be determined in view of variations in external dimensions of sheets. When the position of the movable side end regulating portion is set as described above, when sheets are not stacked, the position where the sheet pressing portion protrudes enters the center of sheets at least by 2 mm.

To ensure a sheet regulating force by the side end regulating portion, a biasing force to be applied to the sheet pressing portion is sometimes increased. As the stacking amount of sheets is reduced, the rigidity of a sheet bundle is also reduced. Accordingly, when the biasing force to be applied to the sheet pressing portion is increased as mentioned above, as the stacking amount of sheets is reduced, the sheets are deformed, so that the sheets cannot be fed stably. When the biasing force to be applied to the sheet pressing portion is reduced so that the sheets are not deformed even if the stacking amount of sheets is reduced, a force of regulating positions of sheets when sheets are fully stacked is insufficient.

Devices for preventing deformation of sheets when fewer sheets are stacked while increasing a pressing force upon the fully stacked sheets are conventionally suggested. For example, a configuration which uses a link to positively vary the pressing force by the sheet pressing portion and reduces the pressing force when the stacking amount of sheets is reduced is suggested (see Japanese Patent Laid-Open No. 2000-118730). However, this configuration increases components, resulting in an increase in cost. A configuration that a relief is formed in a sheet pressing portion so that components are not increased and this relief reduces a pressing force by the sheet pressing portion or the relief does not contact the sheets so that the sheets are not pressed when the stacking amount of sheets is reduced is suggested (see Japanese Patent Laid-Open No. 2000-219330).

According to these conventional sheet feeding apparatuses and image forming apparatuses, a plurality of sheet pressing portions is sometimes provided on the movable side end regulating portion along the sheet feeding direction. As illustrated in FIGS. 8A, 8B, 9A, and 9B, sheets having different sheet feeding direction lengths are sometimes accommodated in a sheet cassette. FIGS. 8A and 8B illustrate a state that A4 size (297 mm×210 mm/ISO 216) sheets are accommodated in the sheet cassette. FIGS. 9A and 9B illustrate a state that A5 size (210 mm×148 mm/ISO 216) sheets are accommodated in the sheet cassette.

As illustrated in FIG. 8A, A4 size sheets Sa are stacked along a side regulating plate 714 serving as the fixed side end regulating portion that forms a reference surface which is a sheet conveyance reference in the width direction. A force is applied to the A4 size sheets Sa toward the side regulating plate 714 by sheet pressing portions 716 and 717 mounted on a side regulating plate 715 serving as an opposing movable side end regulating portion.

As illustrated in FIG. 8B, a biasing member 801 is placed between the side regulating plate 715 and the sheet pressing portion 716 and a biasing member 802 is placed between the side regulating plate 715 and the sheet pressing portion 717. These biasing members 801 and 802 enable the sheet pressing portions 716 and 717 to apply biasing forces P81 and P82 to the A4 size sheets Sa.

The biasing force P81 by the sheet pressing portion 716 on upstream in a sheet feeding direction is a biasing force required to be applied to the stacked sheets Sa with respect to the side regulating plate 714 so that the sheets are in a predetermined attitude, and is, e.g., 1.0 N to 3.0 N. The biasing force P82 by the sheet pressing portion 717 on downstream in a sheet feeding direction with respect to the sheet pressing portion 716 is applied to a fed sheet Sa at the time of sheet feeding to maintain the attitude of the sheet Sa to be in the predetermined attitude. This biasing force P82 is such that sheets are not deformed and is required to be 0.1 N to 0.5 N.

The position where the biasing force P81 acts is preferably near the center of gravity of a sheet, i.e., a sheet feeding direction center of a side surface of the sheet (so the center, in the sheet feeding direction, of a side surface of the sheet) so that the sheet is not rotated about the sheet pressing portion 716 because of an impact when a sheet cassette is inserted.

The biasing force P81 by the sheet pressing portion 716 is applied to the A4 size sheet Sa. In this case, the attitude of the sheet Sa is determined by a triangular area connecting ends M81 and M82 of the side regulating plate 714 and a point of application of the biasing force P81. Assume that the sheet pressing portion 716 is the center of rotation of the sheet Sa and rotation of the sheet Sa is prevented by the side regulating plate 714.

As illustrated in FIG. 8B, when the area connecting the ends M81 and M82 of the side regulating plate 714 and the point of application of the biasing force P81 is an acute triangle, an effect that the side regulating plate 714 prevents the rotation of the sheet Sa with respect to a moment of rotation of the sheet Sa can be expected. The position where the biasing force P81 is applied by the sheet pressing portion 716 is generally in the range of ¼ to ½ of the length in the sheet feeding direction of the A4 size sheet Sa. Referring to FIG. 8B, the position where the biasing force P81 acts is set to ½ of the length in the sheet feeding direction of the A4 size sheet Sa, i.e., the sheet feeding direction center of the A4 size sheet Sa.

As illustrated in FIG. 9A, A5 size sheets Sb are stacked along the side regulating plate 714 like the A4 size sheets Sa. A force is applied to the A5 size sheets Sb toward the side regulating plate 714 by the sheet pressing portions 716 and 717. As illustrated in FIG. 9B, the sheet pressing portions 716 and 717 apply biasing forces P81 and P82 to the A5 size sheets Sb, respectively.

As described above, the position of the sheet pressing portion 716 is determined in view of the attitude and position of the A4 size sheet Sa. When the position of the sheet pressing portion 716 is set to such a position, as illustrated in FIG. 9B, the biasing force P81 is applied to a sheet feeding direction rear end of the A5 size sheet Sb and the A5 size sheet Sb is supported by an area from M83 to M84 with respect to the side regulating plate 714. M83 indicates a corner of the A5 size sheet Sb at a rear end in the sheet feeding direction. In this case, an area connecting M83, M84, and the point of application of the biasing force P81 is substantially a right-angled triangle.

Assume that the sheet pressing portion 716 is the center of rotation of the A5 size sheet Sb and the rotation of the sheet Sb is prevented by the side regulating plate 714. In this case, when the area connecting M83, M84, and the point of application of the biasing force P81 is a right-angled triangle, a unit which resists to a moment of counterclockwise rotation of the A5 size sheet Sb is not provided. Accordingly, the attitude of the sheet Sb cannot be maintained. As described above, because the biasing force P82 by the sheet pressing portion 717 is significantly reduced, the moment of rotation cannot be supported by the biasing force P2 by the sheet pressing portion 717.

When the stacking amount of the A5 size sheets Sb is reduced and thus the rigidity of a sheet bundle is reduced, the sheet feeding direction rear end of a sheet Sb is deformed by the biasing force P81 by the sheet pressing portion 716. Consequently, as illustrated by a line Sb' in FIG. 9B, a front end of the sheet Sb is pressed out and the attitude of the sheet Sb cannot be maintained.

As described above, according to the conventional configuration, when the size (length in the sheet feeding direction) of accommodated sheets is different, positional shifts caused by an impact at the time of mounting/detaching a sheet cassette and deformation of sheets and changes in attitude of the sheets caused by a biasing force cannot be prevented for sheets of all corresponding sizes. For example, the sheet pressing portion can be provided for each sheet size. However, in this case, the configuration is complicated and an increase in cost is problematic.

The present invention has been achieved in view of the above problems, and provides a sheet feeding apparatus and an image forming apparatus that can prevent changes in attitude of sheets when a sheet cassette is mounted and deformation of the sheets and changes in attitude of the sheets after the sheet cassette is mounted regardless of a sheet size.

SUMMARY OF THE INVENTION

The present invention provides a sheet feeding apparatus that feeds sheets, accommodated in a sheet cassette which is detachably mounted on an apparatus main body, in a sheet feeding direction by a sheet feeding portion, the sheet cassette including: a cassette main body arranged to accommodate a stack of sheets stacked in a sheet stacking direction; a pair of opposing side end regulating portions which are provided in the cassette main body and are arranged to regulate the position of the side ends of the sheets in a width direction perpendicular to the sheet feeding direction, wherein at least one of the side end regulating portions is movable in the width direction; a sheet pressing portion provided on one of the side end regulating portions and arranged to press a side end of the stack of sheets to press the sheets against a reference surface provided on the other side end regulating portion serving as a sheet conveyance reference; wherein the sheet pressing portion comprises an indented portion extending upwardly in the sheet stacking direction from a lower end of the sheet pressing portion.

According to the present invention, the sheet pressing portion is provided with the indented portion against which an upstream end of a sheet in the sheet feeding direction does not abut. Accordingly, changes in attitude of sheets when the sheet cassette is mounted and deformation of the sheets and changes in attitude of the sheets after the sheet cassette is mounted can be prevented regardless of the sheet size.

Further features of the present invention will become apparent from the following description of exemplary embodiments with reference to the attached drawings.

DESCRIPTION OF THE EMBODIMENTS

Figure 1:
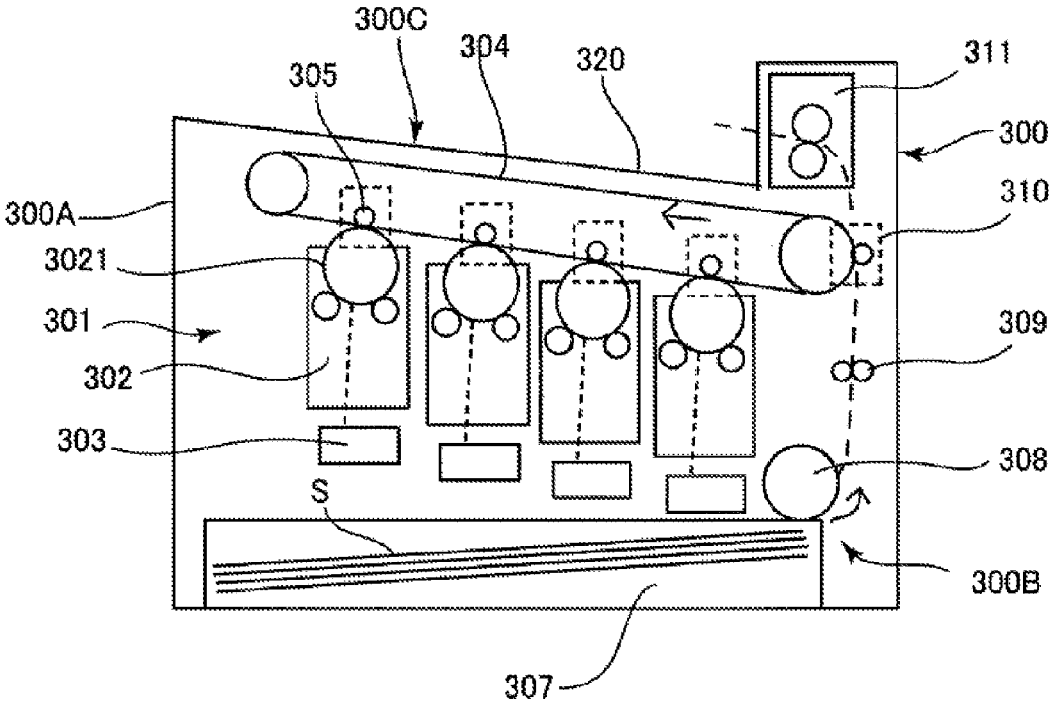
FIG. 1 is a diagram illustrating the configuration of a laser printer which is an example of an image forming apparatus which includes a sheet feeding apparatus according to a first embodiment of the present invention.

Embodiments for carrying out the present invention are described below in detail with reference to the drawings. FIG. 1 is a diagram illustrating the configuration of a laser printer which is an example of an image forming apparatus which includes a sheet feeding apparatus according to a first embodiment of the present invention. The laser printer (hereinafter, printer) is indicated by reference numeral 300. A laser printer main body (hereinafter, printer main body) is indicated by reference numeral 300A. This printer main body 300A includes an image forming portion 301 which forms images on sheets S and a sheet feeding apparatus 300B which feeds the sheets S from a sheet cassette 307.

The image forming portion 301 includes scanner units 303 and four process cartridges 302 which form toner images of four colors, i.e., yellow (Y), magenta (M), cyan (C), and black (Bk). The image forming portion 301 also includes an intermediate transfer unit 300C placed above the process cartridges 302. Each process cartridge 302 includes a photosensitive drum 3021.

The intermediate transfer unit 300C includes an intermediate transfer belt 304 and primary transfer rollers 305 that are provided inside the intermediate transfer belt 304 and abut the intermediate transfer belt 304 at positions opposing the respective photosensitive drums 3021. By applying a positive transfer bias to the intermediate transfer belt 304 by the primary transfer rollers 305, negative toner images of the respective colors on the photosensitive drums are successively multi-layer transferred to the intermediate transfer belt 304. A full color image is thus formed on the intermediate transfer belt.

An image forming operation of the printer 300 with such a configuration will now be described. When the image forming operation starts, the scanner unit 303 irradiates laser light based on image information from a personal computer (not illustrated) and successively exposes a surface of the photosensitive drum 3021 uniformly charged to a predetermined polarity/potential with the laser light, so that an electrostatic latent image is formed on the photosensitive drum. The electrostatic latent image is then developed by a toner and thus visualized.

A yellow toner image, a magenta toner image, a cyan toner image, and a black toner image formed on the photosensitive drums 3021 of the respective process cartridges 302 are then transferred to the intermediate transfer belt 304 by the primary transfer rollers 305 in the respective primary transfer portions. A full color toner image is thus formed on the intermediate transfer belt 304.

In parallel with the toner image forming operation, a sheet S accommodated in the sheet cassette 307 is fed by a feed roller 308 serving as a sheet feeding portion placed near a front end of the sheet S. Skew feeding of this sheet S is corrected by a pair of registration rollers 309 and then the pair of registration rollers 309 is driven so that the full color toner image on the intermediate transfer belt is registered with respect to the sheet S in a secondary transfer portion 310.

The sheet S is conveyed to the secondary transfer portion 310 by the pair of registration rollers 309 so that the full color toner image on the intermediate transfer belt 304 is registered with respect to the sheet S in the secondary transfer portion 310. The full color toner image is thus transferred to the sheet S at a time in the secondary transfer portion 310. The sheet S to which the full color toner image is transferred as described above is then conveyed to a fixing portion 311. Application of heat and pressure to the sheet S in this fixing portion 311 makes toners of the respect colors melt and mix with each other, so that the toners are fixed on the sheet S as a full color image. The sheet S which passes through the fixing portion 311 is then discharged to a discharge tray 320 provided on a top surface of the printer main body with its image surface facing downward.

The sheet cassette 307 is detachably provided in the printer main body 300A which is also a main body of the sheet feeding apparatus 300B. When sheets are supplemented (added), as illustrated in FIG. 2, the sheet cassette 307 is drawn from the printer main body 300A in a width direction perpendicular to a sheet feeding direction.

Figure 2:
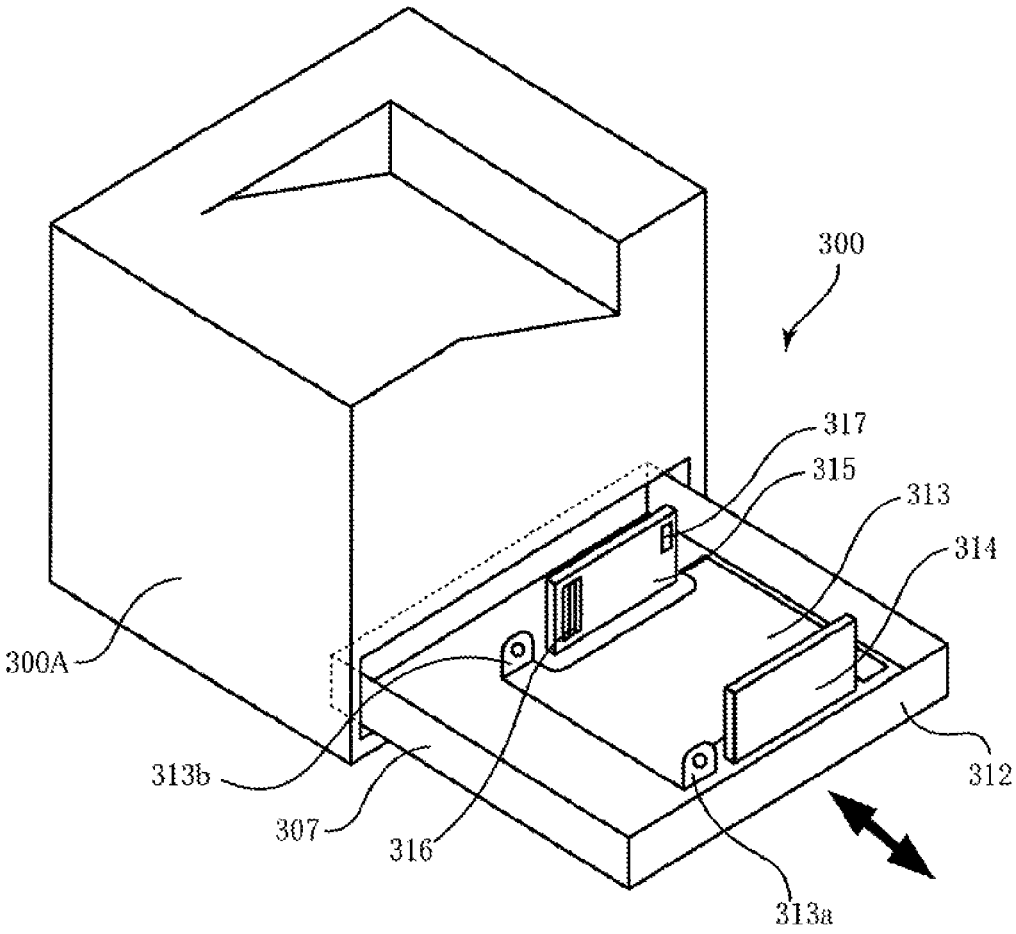
FIG. 2 is a diagram for describing the configuration of a sheet cassette which is detachably provided in a printer main body of the laser printer.

As illustrated in FIG. 2, a sheet stacking plate 313 serving as a sheet stacking portion is placed in a frame 312 which forms a main body of the sheet cassette 307 so as to be rotatable about support portions 313*a* and 313*b* in a vertical direction. Every time a stacked sheet is fed, a side end of the sheet stacking plate 313 on downstream in the sheet feeding direction is rotated upward by a biasing unit (not illustrated) between the frame 312 and the sheet stacking plate 313.

A pair of side regulating plates 314 and 315 which is a pair of side end regulating portions for regulating a position of a width direction side end of the sheet S is further placed in the frame 312 so that the plates 314 and 315 oppose with each other. The side regulating plate 314 is fixed to the frame 312. The fixed side regulating plate 314 serving as a fixed side end regulating portion forms a reference surface of the sheet S in the width direction. When the sheet S is fed, it is fed along the fixed side regulating plate 314, so that predetermined printing precision is accomplished.

The side regulating plate 315 can slide in the width direction and is configured to slide in the width direction according to the size of accommodated sheets. While the side regulating plate 315 which is at least one of the side regulating plates 314 and 315 and serves as the side end regulating portion is movable in the first embodiment, the side regulating plate 314 which is the other side end regulating portion can be also movable.

Sheet pressing portions 316 and 317 that press sheets are provided on an inner wall surface of the movable side regulating plate 315 serving as the movable side end regulating portion. These sheet pressing portions 316 and 317 press the sheet S stacked on the sheet stacking plate 313 against the opposing fixed side regulating plate 314. By these sheet pressing portions 316 and 317, when the sheet S is shifted in the width direction to be separated from the fixed side regulating plate 314 because of an impact at the time of accommodating (inserting) the sheet cassette 307, the sheet S can be pressed back to the fixed side regulating plate 314.

Figure 3A:
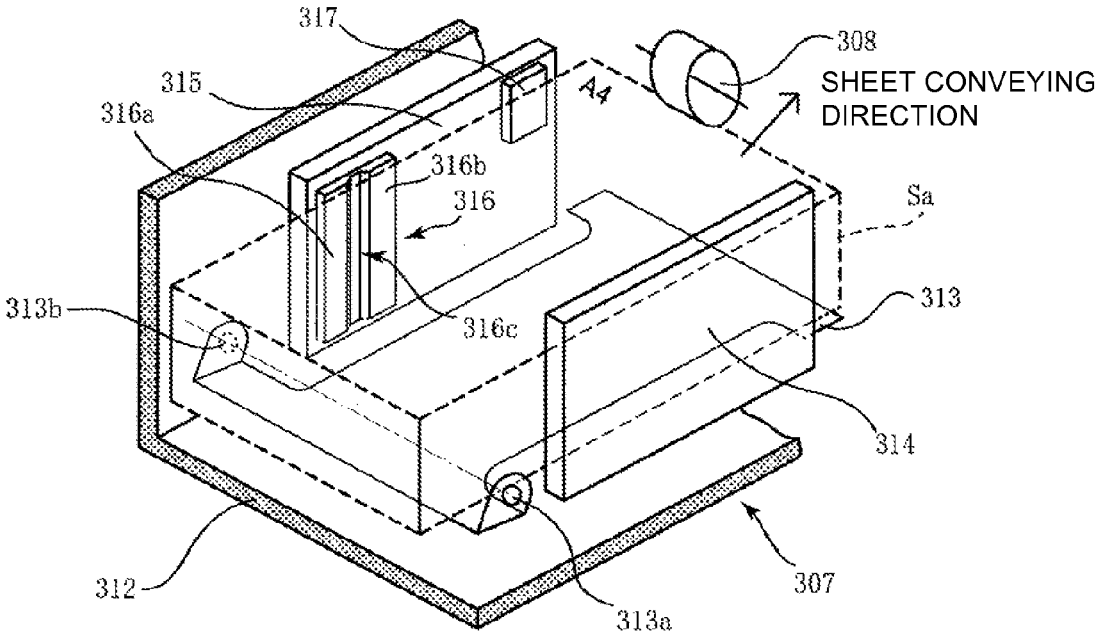
FIGS. 3A and 3B are diagrams illustrating a state when A4 size sheets are stacked in the sheet cassette.
Figure 3B:
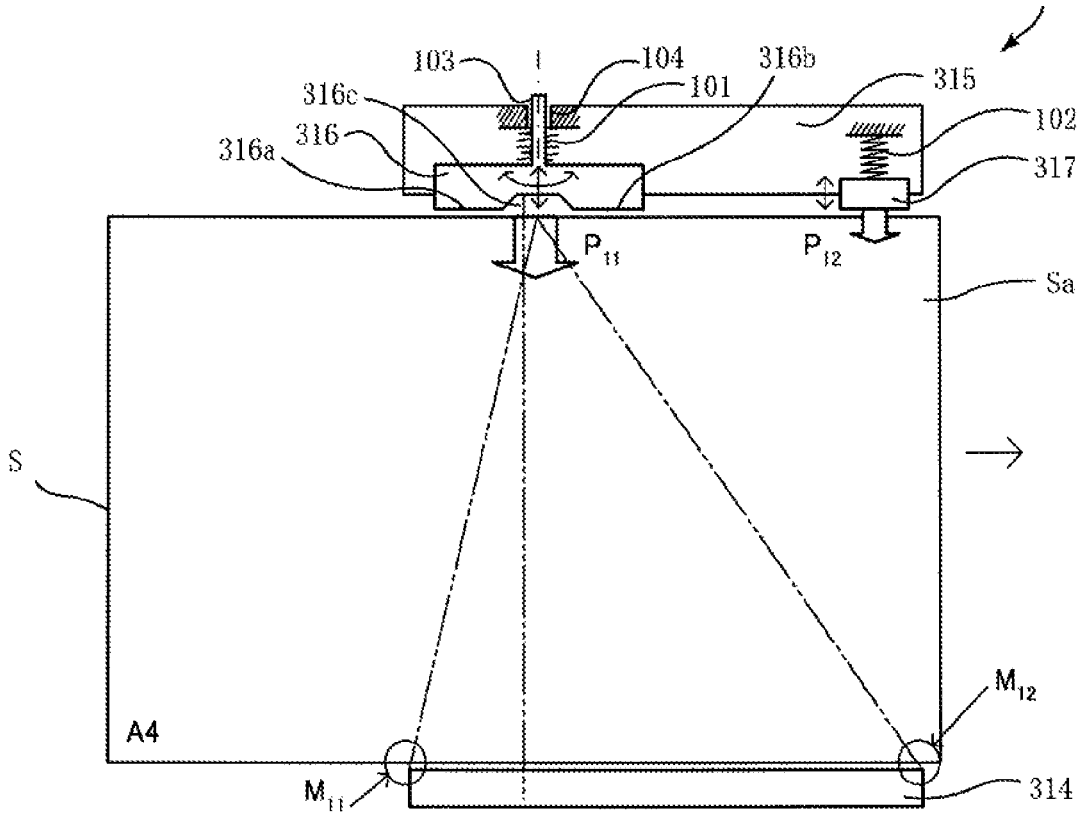

Sheets having different lengths in the sheet feeding direction, i.e., A4 size and A5 size sheets in the first embodiment can be accommodated in the sheet cassette 307. FIGS. 3A and 3B illustrate a state that A4 size sheets Sa are accommodated in the sheet cassette 307. As illustrated in FIG. 3A, the A4 size sheets Sa are stacked along the side regulating plate 314 which forms the reference surface serving as a conveyance reference in the width direction at the time of conveying sheets. A force is applied to the A4 size sheets Sa toward side regulating plate 314 by the sheet pressing portions 316 and 317 mounted on the side regulating plate 315.

As illustrated in FIG. 3B, biasing members 101 and 102 such as springs are placed between the side regulating plate 315 and the sheet pressing portion 316 and between the side regulating plate 315 and the sheet pressing portion 317, respectively. By these biasing members 101 and 102, the sheet pressing portion 316 applies a biasing force P11 and the sheet pressing portion 317 applies a biasing force P12 to an A4 size sheet Sa.

According to the first embodiment, a support hole 104 into which a support shaft 103 provided on the sheet pressing portion 316 on a upstream in the sheet feeding direction is inserted is formed in the side regulating plate 315. The inner diameter of the support hole 104 is larger than the outline of the support shaft 103 by a predetermined quantity. The sheet pressing portion 316 is thus supported by the side regulating plate 315 so as to be movable in the sheet width direction and swingable in a horizontal direction indicated by an arrow by a difference between the diameter of the support shaft 103 and the diameter of the support hole 104.

The biasing force P11 by the sheet pressing portion 316 is a biasing force required to be applied to the stacked sheet Sa to obtain a predetermined attitude with respect to the side regulating plate 314, e.g., 1.0 N to 3.0 N. A position where the biasing force P11 acts is preferably near the center of gravity of the sheet Sa, i.e., a sheet feeding direction center of a side surface of the sheet so that the sheet Sa is not rotated about the sheet pressing portion 316 because of an impact at the time of inserting the sheet cassette.

The biasing force P12 by the sheet pressing portion 317 positioned on downstream in a sheet feeding direction with respect to the sheet pressing portion 316 is a force, at the time of feeding a sheet, applied to the fed sheet Sa for maintaining a predetermined attitude of the sheet Sa. The biasing force P12 is such that the sheet Sa is not deformed and about 0.1 N to 0.5 N is required.

The biasing force P11 by the sheet pressing portion 316 is applied to the A4 size sheet Sa toward the side regulating plate 314. In this case, the attitude of the sheet Sa is determined by a triangular area connecting ends M11 and M12 of the side regulating plate 314 and a point of application of the biasing force P11 on the axis of the support shaft 103. Assume that the sheet pressing portion 316 is the center of rotation of the A4 size sheet Sa and the rotation of the A4 size sheet Sa is prevented by the side regulating plate 314.

When the area connecting the ends M11 and M12 of the side regulating plate 314 and the point of application of the biasing force P11 is an acute triangle, the effect that the side regulating plate 314 prevents the rotation of the A4 size sheet Sa can be expected. The position where the biasing force P11 by the sheet pressing portion 316 acts is thus set to ½ of the length in the sheet feeding direction of the A4 size sheet Sa, i.e., the sheet feeding direction center.

Figure 4A:
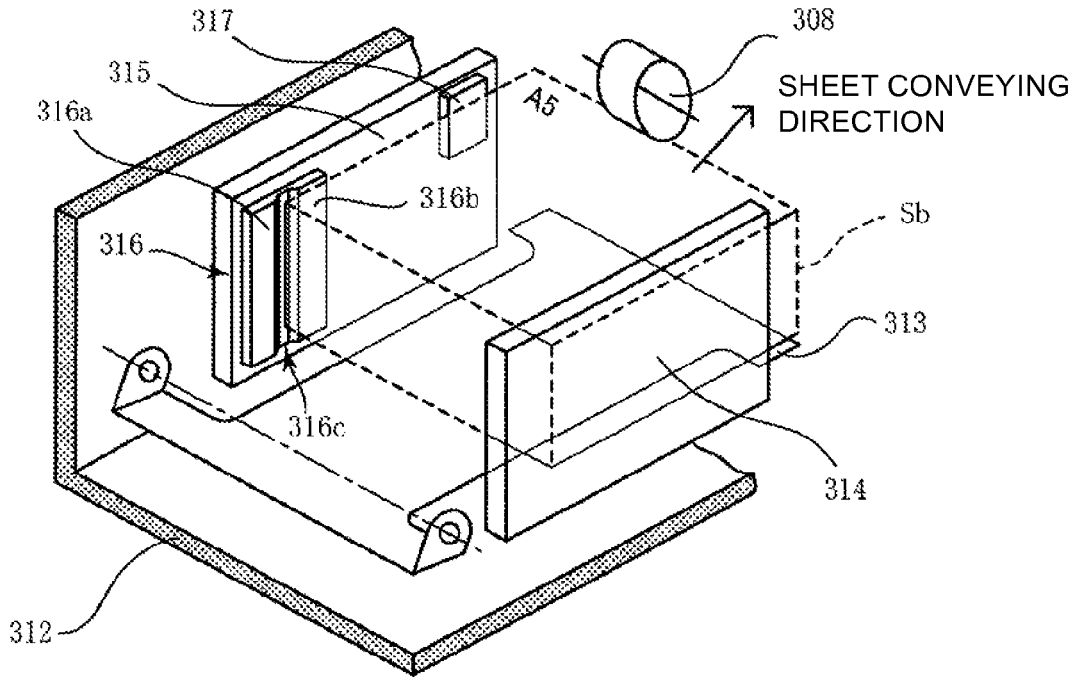
FIGS. 4A and 4B are diagrams illustrating a state when A5 size sheets are stacked in the sheet cassette.
Figure 4B:
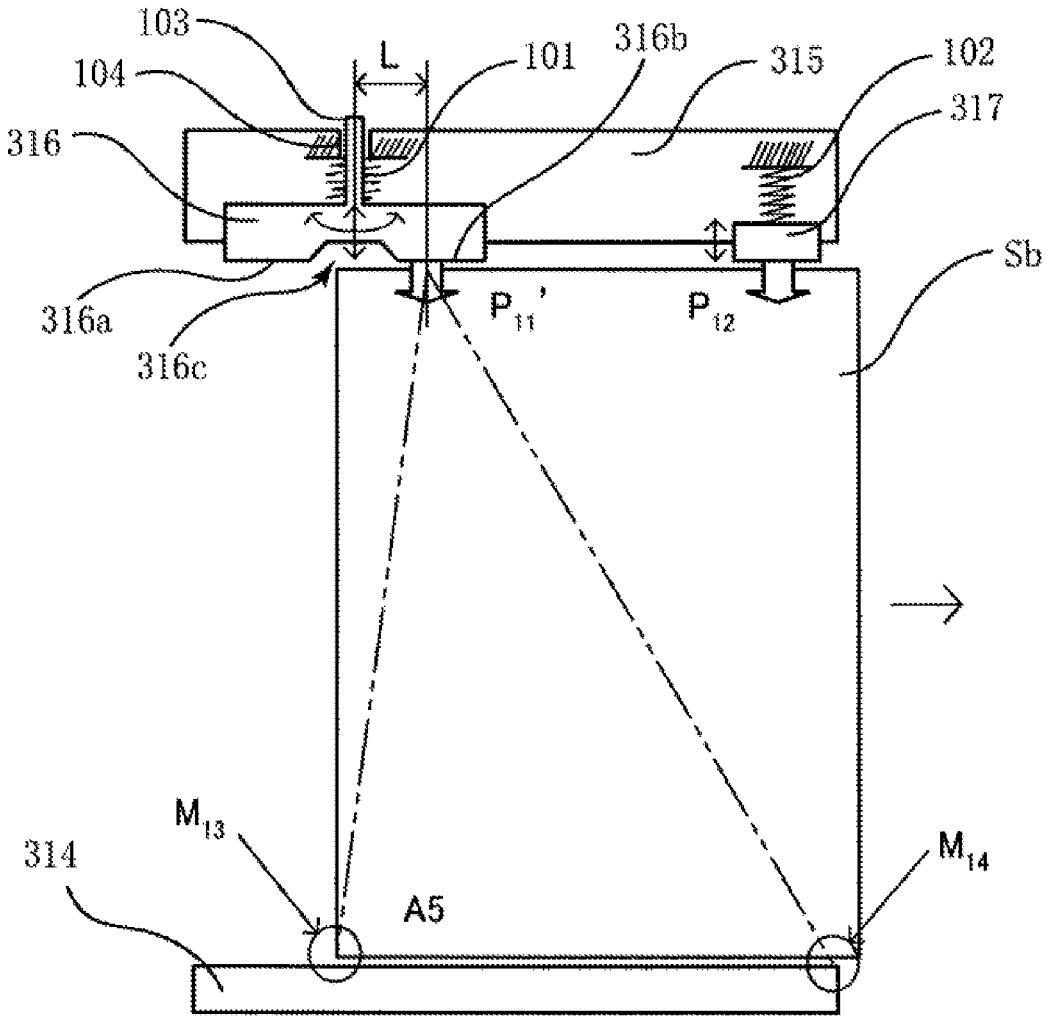

FIGS. 4A and 4B illustrate a state that short A5 size sheets Sb whose upstream ends in the sheet feeding direction are pressed by the sheet pressing portion 316 are accommodated in the sheet cassette 307. As illustrated in FIG. 4A, the A5 size sheets Sb are stacked along the side regulating plate 314 and a force is applied to the A5 size sheets Sb toward the side regulating plate 314 by the sheet pressing portions 316 and 317 mounted on the side regulating plate 315.

As illustrated in FIGS. 3A, 3B, 4A and 4B, an indented or depressed (concave) configuration 316*c* which extends in the vertical direction and against which, when the A5 size sheets Sb are stacked, corners of the sheets Sb at rear ends in sheet feeding direction do not abut is provided at the sheet conveying direction center of a sheet side of the sheet pressing portion 316. Sheet biasing portions 316*a* and 316*b* that abut the side ends of the sheets to apply a force to the sheets are provided on sides of the indented configuration 316*c*. The indented configuration 316*c* which is an indentation or depression is formed from a bottom end to a top end of the sheet pressing portion 316 at a position opposing the corners of the A5 size sheets Sb at the rear ends in the sheet feeding direction.

Among the sheet biasing portions 316*a* and 316*b* serving as a side end pressing portion, the sheet biasing portion 316*a* on upstream in the sheet feeding direction does not apply a force to an A5 size sheet Sb. By forming the indented configuration 316*c* in the sheet pressing portion 316, a force is applied to the downstream of the A5 size sheet Sb with respect to the corner of the sheet Sb at the rear end in the sheet feeding direction by the sheet biasing portion 316*b* of the sheet pressing portion 316 on downstream in the sheet feeding direction.

As illustrated in FIG. 4B, the positional relationship between the support shaft 103 of the sheet pressing portion 316 to which the biasing member 101 applies a force and the sheet biasing portion 316*b* is such that the sheet biasing portion 316*b* is offset in the sheet feeding direction by a length L. As described above, the sheet pressing portion 316 can rotate about the support shaft 103 in parallel with the sheet feeding direction indicated by the arrow, i.e., in the horizontal direction. Accordingly, even when the outline dimension of the sheets Sb varies, a force can be uniformly applied to the side ends of the sheets Sb.

A biasing force P11' only by the sheet biasing portion 316*b* is smaller than the biasing force P11 by the two sheet biasing portions 316*a* and 316*b*. When the A5 size sheets Sb are accommodated, a force is applied to the sheets Sb only by the sheet biasing portion 316*b*, so that the biasing force P11' can be set to be small. The biasing force P11' by the sheet biasing portion 316*b* can correspond to various conditions according to the length L, the positional relationship between the sheet pressing portion 316 and a sheet, and the biasing force by the biasing member 101.

An operation of pressing the A5 size sheet Sb by the sheet pressing portion 316 with such a configuration will now be described. When the sheet cassette 307 is mounted, the biasing force P11' is applied to the rear end of the A5 size sheet Sb. Further, the A5 size sheet Sb is supported with respect to the opposing side regulating plate 314 by an area from ends M13 to M14 of the side regulating plate 314 illustrated in FIG. 4B. The end M13 of the side regulating plate 314 is a corner of the A5 size sheet Sb at the rear end in the sheet feeding direction. In this case, an area connecting the ends M13 and M14 and the point of application of the biasing force P11' is an acute triangle.

Assume that the sheet biasing portion 316*b* of the sheet pressing portion 316 is the center of rotation of the A5 size sheet Sb and the rotation of the A5 size sheet Sb is prevented by the side regulating plate 314. In this case, when the area connecting the ends M13 and M14 and the point of application of the biasing force P11' is an acute triangle, the effect that the side regulating plate 314 prevents the rotation of the A5 size sheet Sa can be expected.

Even when the stacking amount of the A5 size sheets Sb is reduced and thus the rigidity of a sheet bundle is reduced, the sheet bundle is not deformed and the attitude of the sheet bundle can be maintained because the sheet biasing portion 316*b* does not press the easily deformable rear ends. Because the biasing force P11' by the sheet biasing portion 316*b* is smaller than the biasing force P11, it is advantageous to the deformation of the sheet bundle.

As described above, according to the first embodiment, the indented configuration 316*c* is provided in the sheet pressing portion 316 so that the corner at the rear end of the A5 size sheet Sa whose length in the sheet feeding direction is shorter among two types of sheets, i.e., A4 and A5 size sheets is not pressed (a force is not applied to the corner). The attitude of the A5 size sheet Sb can be stabilized at the time of accommodating and feeding the sheet Sb, as well as the A4 size sheet Sa.

Namely, a force is not applied to a corner at the rear end of a sheet whose length in the sheet feeding direction is shorter among at least two types of sheets. Changes in attitude of the sheet caused by an impact at the time of mounting/detaching the sheet cassette 307, the deformation of the sheet, and changes in attitude of the sheet during feeding can be prevented. While the case of providing one indented configuration 316*c* in the sheet pressing portion 316 is described, when the other shorter sheet is accommodated, the other indented configuration can be provided at the position where a force is not applied to a corner at the rear end of the sheet.

Figure 5:
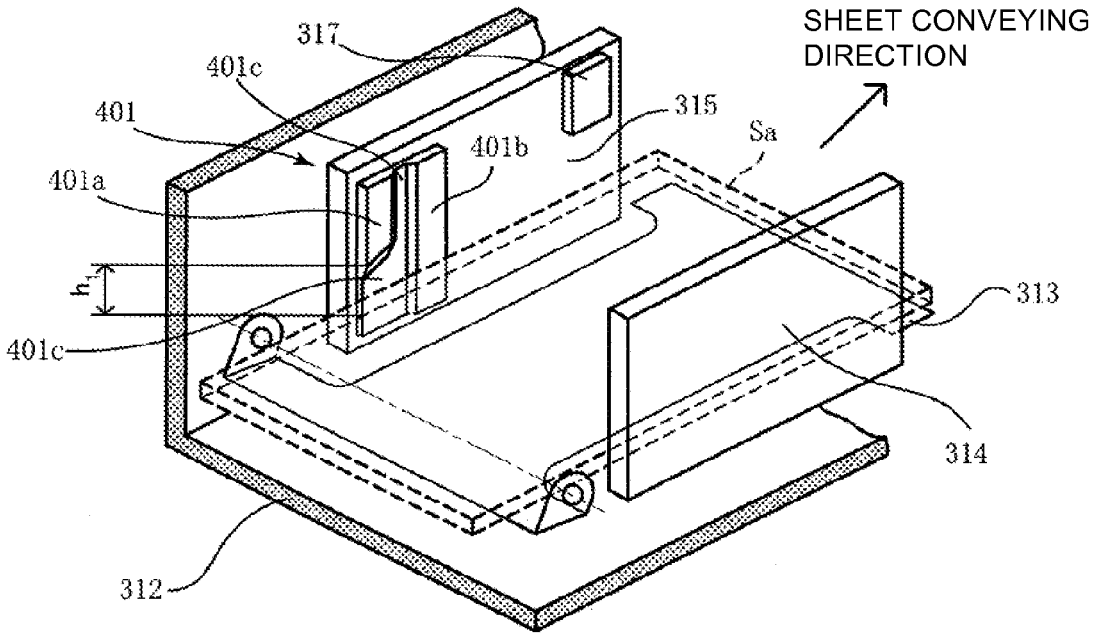
FIG. 5 is a perspective view of a sheet cassette mounted on a sheet feeding apparatus according to a second embodiment of the present invention.

A second embodiment of the present invention will now be described. FIG. 5 is a perspective view of a sheet cassette mounted on a sheet feeding apparatus of the second embodiment. The same reference numerals in FIG. 5 as those of the above-described FIGS. 3A and 3B indicate the same or corresponding parts.

Referring to FIG. 5, a sheet pressing portion 401 is placed on upstream in the sheet feeding direction of the side regulating plate 315. An indented configuration 401*c* which is an indentation or depression formed at a sheet feeding direction center and extending in a vertical direction and sheet biasing portions 401*a* and 401*b* that are placed on sides of the indented configuration 401*c* and abut a side end of a sheet to apply a force to the sheet are provided on a sheet side of the sheet pressing portion 401. The indented configuration 401*c* is formed at a position opposing a corner of the A5 size sheet Sb at the rear end in the sheet feeding direction.

According to the second embodiment, a lower portion of the sheet biasing portion 401*a* on upstream in the sheet feeding direction, e.g., a portion from the top surface of the sheet stacking plate 313 to a predetermined height h1 is cut out. This cutout portion is continuous with the indented configuration 401*c*. Namely, the sheet biasing portion 401*a* on upstream in the sheet feeding direction is placed at a position higher than the top surface of the sheet stacking plate 313 by the predetermined height h1.

In the case of stacking the A4 size sheets Sa, when the stacking amount of sheets is equal to or lower than the height h1 from the top surface of the sheet stacking plate 313, the sheet biasing portion 401*a* does not apply a force to the sheets Sa. As a result, a force to be applied to the A4 size sheets Sa is reduced. Even in the case of reduced stacking amount of sheets that the rigidity of a sheet bundle is relatively reduced, the sheets are not deformed, the sheet bundle is stabilized, and its attitude can be maintained.

As described above, by providing the sheet biasing portion 401*a* on upstream in the sheet feeding direction at a position higher than the top surface of the sheet stacking plate 313 by the predetermined height h1, the attitude of the A4 size sheet Sa can be also stabilized. Regardless of the sheet size, desired printing precision and feed performance can be realized.

Figure 6:
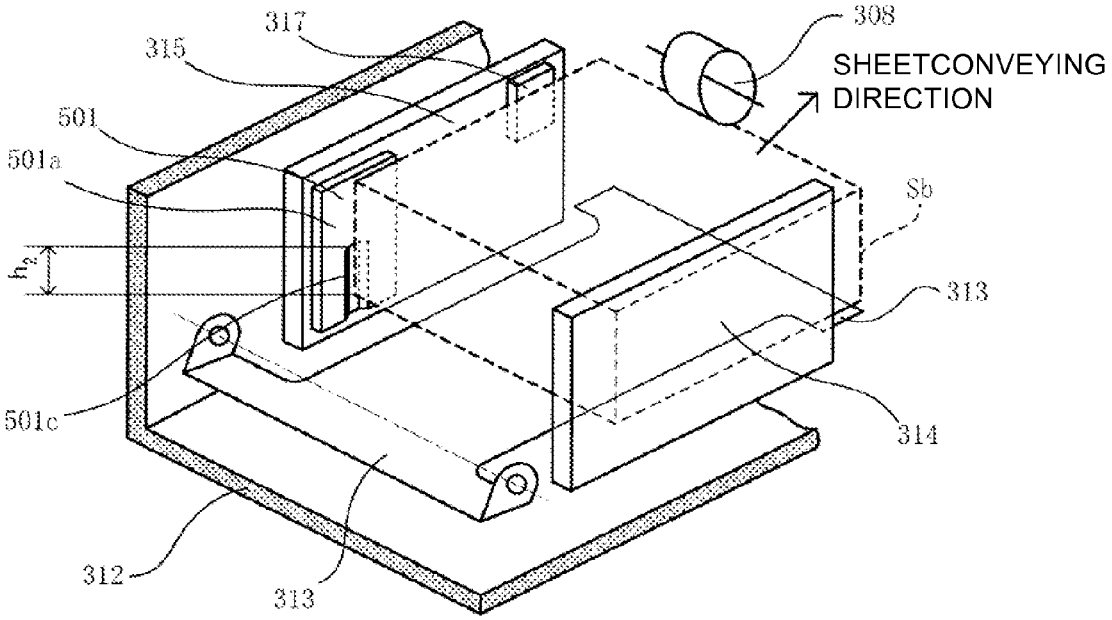
FIG. 6 is a perspective view of a sheet cassette mounted on a sheet feeding apparatus according to a third embodiment of the present invention.

A third embodiment of the present invention will now be described. FIG. 6 is a perspective view of a sheet cassette mounted on a sheet feeding apparatus of the third embodiment. The same reference numerals in FIG. 6 as those of above-described FIGS. 3A and 3B indicate the same or corresponding parts.

Referring to FIG. 6, a sheet pressing portion 501 is placed on upstream in the sheet feeding direction of the side regulating plate 315. An indented configuration 501*c* which is a depression or indentation starting from the bottom end of the sheet pressing portion 501 and extending upward from the top surface of the sheet stacking plate 313 in a horizontal state to a predetermined height h2 is formed at the sheet feeding direction center of a sheet side of the sheet pressing portion 501. The indented configuration 501*c* formed upward from the bottom end of the sheet pressing portion 501 to the predetermined dimension is provided at a position opposing a corner of the A5 size sheet Sb at a rear end in the sheet feeding direction.

By forming such an indented configuration 501*c*, a sheet biasing portion 501*a* of the sheet pressing portion 501 can apply a force to a corner of the A5 size sheet Sb at the rear end in the sheet feeding direction before the stacking amount of sheets is equal to or lower than the height h2 from the top surface of the sheet stacking plate 313. Even in the case of the A5 size sheet Sb, before the stacking amount of sheets reaches the height h2 from the top surface of the sheet stacking plate 313, the biasing force P11 by the sheet pressing portion 501 can apply to the sheet Sb.

Even in the case of the A5 size sheet Sb, when the biasing force P11 of the sheet pressing portion 501 is insufficient because of a large density of sheets, width direction movement of the sheet Sb can be regulated in the range of the stacking amount of sheets that the rigidity of a sheet bundle is high. When the stacking amount of sheets is reduced and thus the rigidity of the sheet bundle is also reduced, the indented configuration 501*c* opposes a corner of the sheet Sb at a rear end in the sheet feeding direction. Accordingly, the same effects as in the above-described first embodiment can be obtained.

As described above, according to the third embodiment, before the stacking height of sheets on the sheet stacking plate 313 is a predetermined one, the biasing force P11 by the sheet pressing portion 501 can be applied to the sheet Sb and the width direction movement of the sheet Sb can be regulated.

Figure 7:
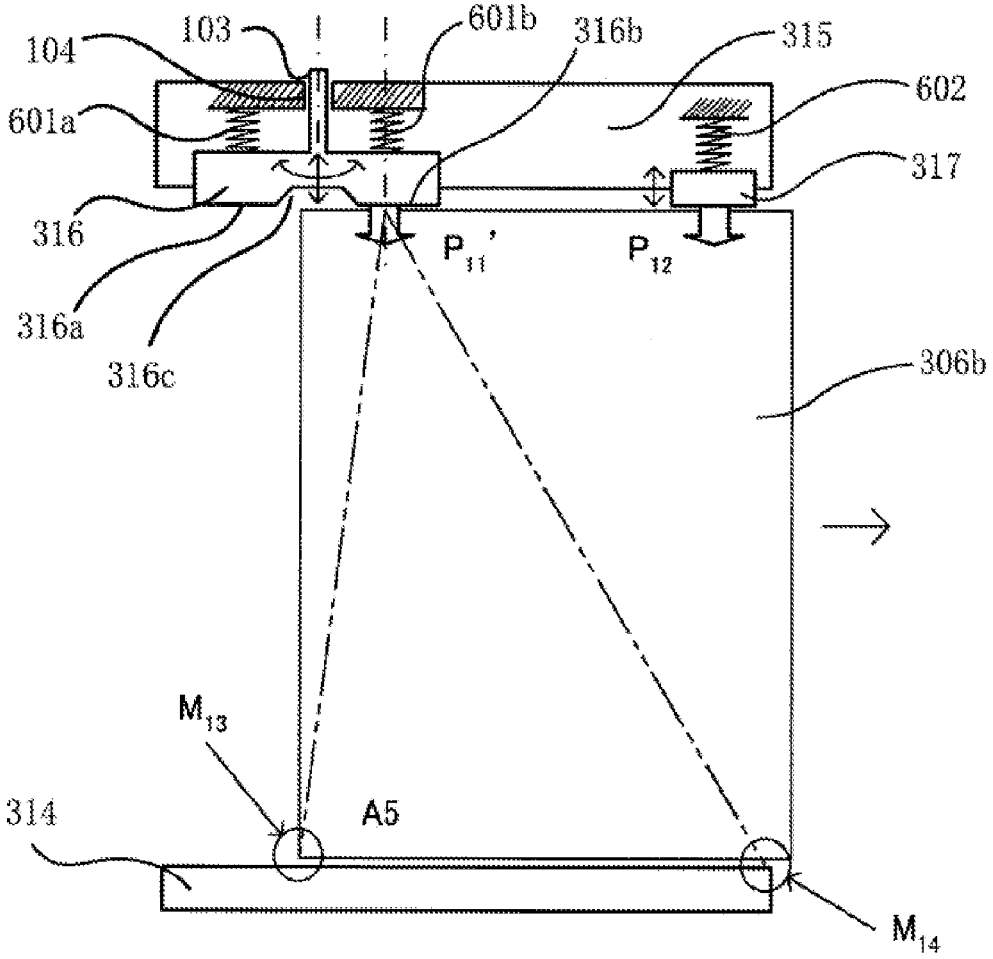
FIG. 7 is a plan view of a sheet cassette mounted on a sheet feeding apparatus according to a fourth embodiment of the present invention.
Figure 8A:
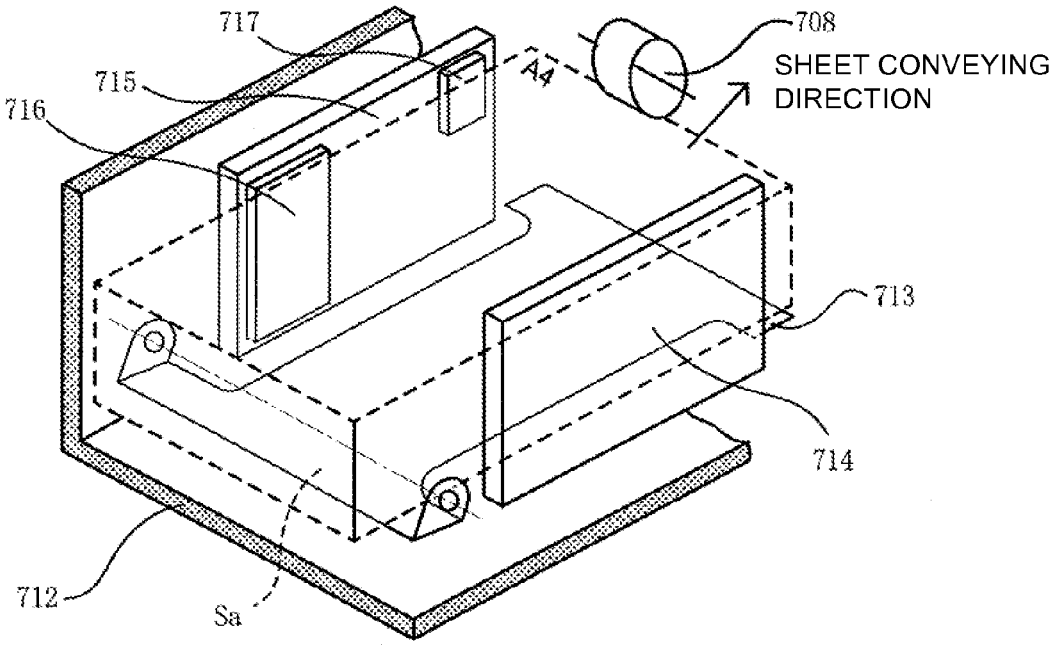
FIG. 8A PRIOR ART
FIGS. 8A and 8B are diagrams illustrating a state when A4 size sheets are stacked in a conventional sheet cassette.
Figure 8B:
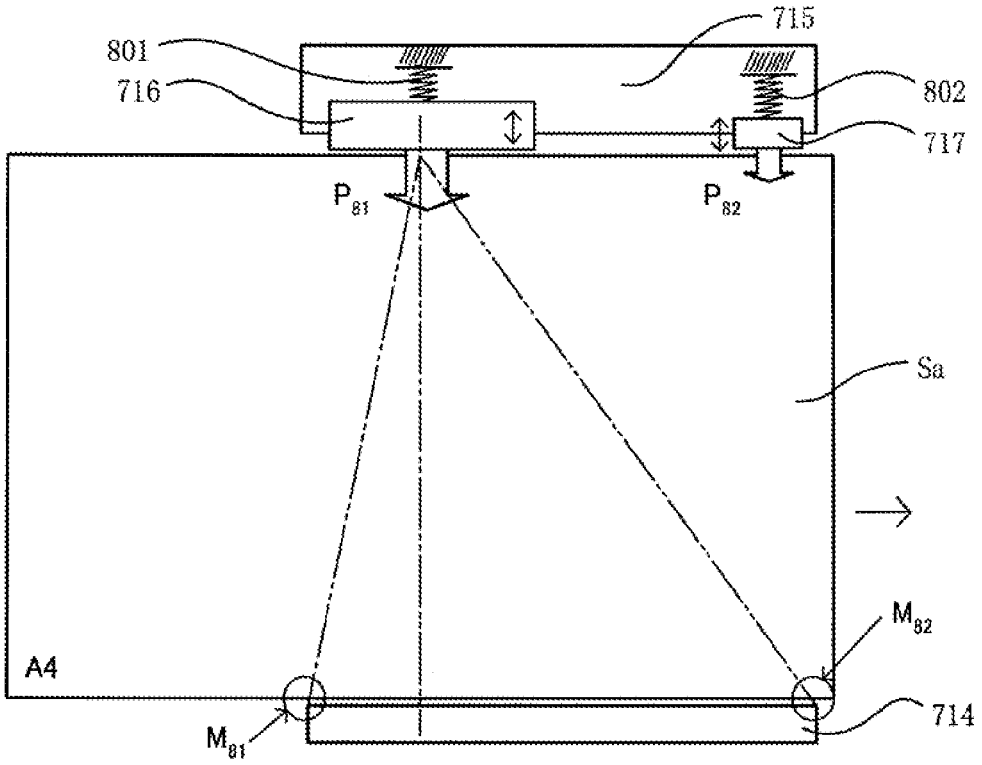
FIG. 8B PRIOR ART
Figure 9A:
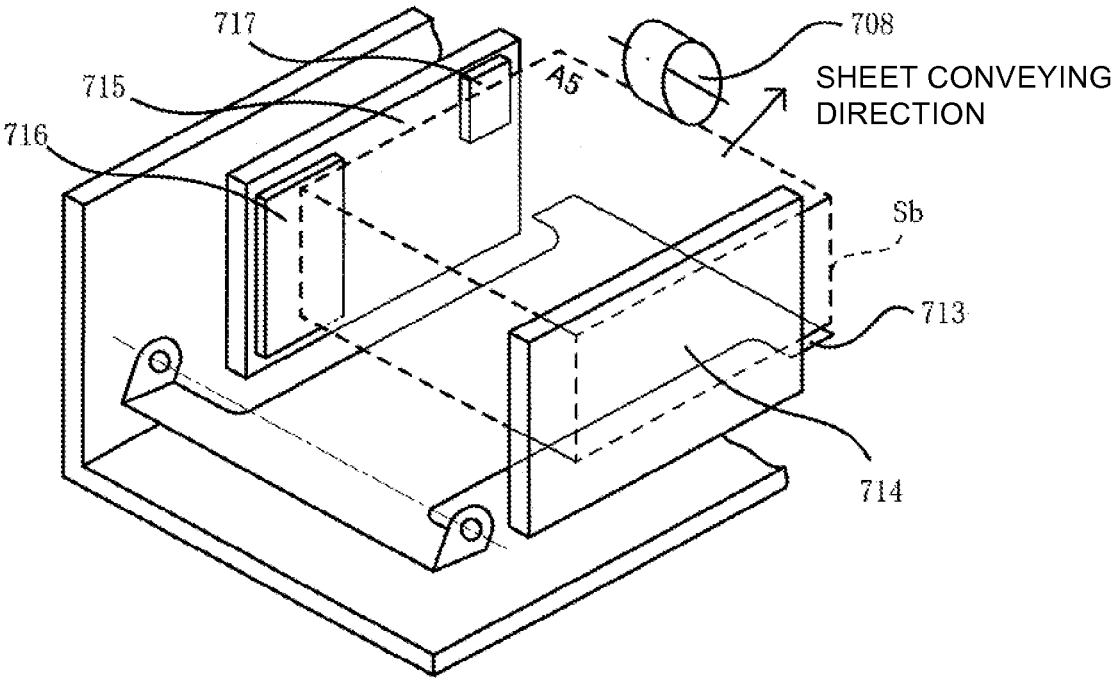
FIG. 9A PRIOR ART
FIGS. 9A and 9B are diagrams illustrating a state when A5 size sheets are stacked in the conventional sheet cassette.
Figure 9B:
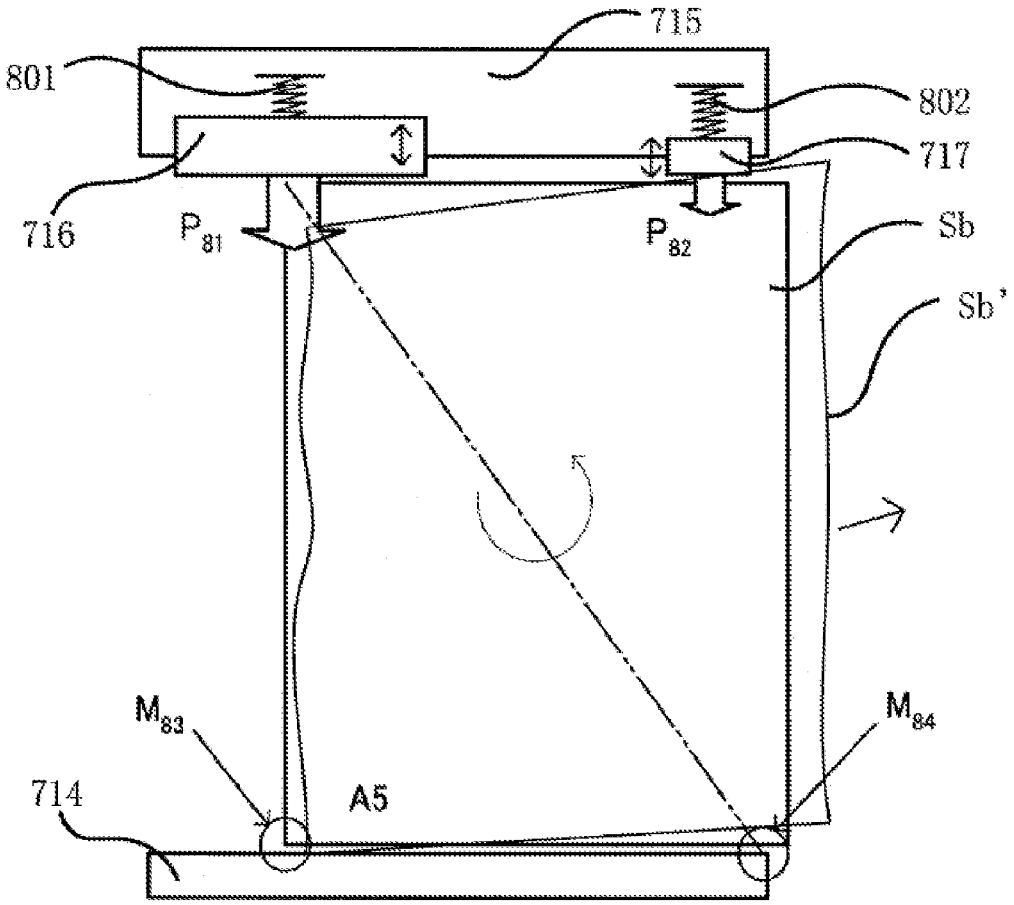
FIG. 9B PRIOR ART

A fourth embodiment of the present invention will now be described. FIG. 7 is a plan view of a sheet cassette mounted on a sheet feeding apparatus of the fourth embodiment. The same reference numerals in FIG. 7 as those of above-described FIGS. 3A and 3B indicate the same or corresponding portions.

Referring to FIG. 7, two (a plurality of) biasing members 601*a* and 601*b* are provided between the sheet pressing portion 316 and the side regulating plate 315. When A5 size sheets are stacked on the sheet stacking plate 313, by providing an indented configuration 316*c* which is a depression or indentation in the sheet pressing portion 316, a biasing force to be applied to the sheet Sb only by the sheet biasing portion 316*b* can be a biasing force only by the biasing member 601*b*.

A biasing force which is applied to the rear end of an A5 size sheet whose length in the sheet feeding direction is short can thus be optimized and a force can be applied to the rear end of the A5 size sheet with higher precision. A biasing force to be applied to the A4 size sheet Sa is set so that the sum of the forces by the two biasing members 601*a* and 601*b* is equal to that of P11 illustrated in FIG. 1.

As described above, according to the fourth embodiment, the biasing force applied to the sheet Sb only by the sheet biasing portion 316*b* can be the biasing force only by the biasing member 601*b*. The biasing force applied to the rear end of the A5 size sheet is thus optimized. Changes in attitude of sheets caused by an impact at the time of mounting the sheet cassette 307 and deformation of the sheets and changes in attitude of the sheets during feeding can be prevented in an optimized manner.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-254483, filed Nov. 15, 2010, which is hereby incorporated by reference herein in its entirety.

What is claimed is:

1. A sheet feeding apparatus that feeds sheets, accommodated in a sheet cassette which is detachably mounted on an apparatus main body, in a sheet feeding direction by a sheet feeding portion, the sheet cassette including:

a cassette main body arranged to accommodate at least two sizes of sheets, a first size and a second size smaller than the first size;

a pair of opposing side end regulating portions which are provided in the cassette main body and are arranged to regulate the position of the side ends of the sheets in a width direction perpendicular to the sheet feeding direction, wherein at least one of the side end regulating portions is movable in the width direction;

a first sheet pressing portion provided on one of the side end regulating portions;

a second sheet pressing portion positioned downstream in the sheet feeding direction with respect to the first sheet pressing portion;

a first biasing member, provided between one of the side end regulating portions and the first sheet pressing portion, which biases the first sheet pressing portion to press the sheets against a reference surface provided on the other side end regulating portion serving as a sheet conveyance reference; and a second biasing member, provided between one of the side end regulating portions and the second sheet pressing portion, which biases the second sheet pressing portion to press the sheets against the reference surface, wherein a pressing force to press the sheet by the second sheet pressing portion biased by the second biasing member is weaker than a pressing force to press the sheets by the first sheet pressing portion biased by the first biasing member, wherein the first sheet pressing portion comprises an indented portion that forms closely-aligned sheet biasing portions provided on both sides of the indented portion in the sheet feeding direction to press side ends of the sheets, and the indented portion is arranged to face upstream edges of the sheets of the second size in the sheet feeding direction, so that both of the sheet biasing portions and the second sheet pressing portion press the sheets of the first size against the reference surface, and one of the sheet biasing portions at a downstream side of the indented portion and the second sheet pressing portion press the sheets of the second size.

2. The sheet feeding apparatus according to claim 1, wherein the indented portion is provided substantially in the center of the first sheet pressing portion in the sheet feeding direction.

3. The sheet feeding apparatus according to claim 1, wherein the indented portion extends from the lower end of the first sheet pressing portion to a top end of the first sheet pressing portion.

4. The sheet feeding apparatus according to claim 3, wherein the first sheet pressing portion includes an upstream side end pressing portion positioned upstream of the indented portion in the sheet feeding direction and a downstream side end pressing portion positioned downstream of the indented portion in the sheet feeding direction.

5. The sheet feeding apparatus according to claim 4, wherein the upstream side end pressing portion presses the first sized sheets positioned above a predetermined height in the stack but not the first sized sheets positioned below the predetermined height in the stack.

6. The sheet feeding apparatus according to claim 4, wherein the first biasing member applies a force to the upstream side end pressing portion and the second biasing member applies a force to the downstream side end pressing portion.

7. The sheet feeding apparatus according to claim 1, wherein the indented portion extends to a height below a top end of the first sheet pressing portion in the sheet stacking direction.

8. The sheet feeding apparatus according to claim 1, wherein the first sheet pressing portion is provided on the movable side end regulating portion.

9. The sheet feeding apparatus according to claim 1, comprising a sheet stacking portion which is provided on the cassette main body and accommodates the stack of sheets wherein an end of the sheet stacking portion can be raised.

10. An image forming apparatus comprising:

an image forming portion;

a sheet cassette; and a sheet feeding portion for feeding sheets from the sheet cassette in a sheet feeding direction, the sheet cassette including:

a cassette main body which accommodates at least two sizes of sheets, a first size and a second size smaller than the first size;

a pair of opposing side end regulating portions which are provided in the cassette main body and regulate the position of the side ends of the sheets stacked on the sheet stacking portion in a width direction perpendicular to the sheet feeding direction, wherein at least one of the side end regulating portions is movable in the width direction;

a first sheet pressing portion provided on one of the side end regulating portions;

a second sheet pressing portion positioned downstream in the sheet feeding direction with respect to the first sheet pressing portion;

a first biasing member, provided between one of the side end regulating portions and the first sheet pressing portion, which biases the first sheet pressing portion to press the sheets against a reference surface provided on the other side end regulating portion serving as a sheet conveyance reference; and a second biasing member, provided between one of the side end regulating portions and the second sheet pressing portion, which biases the second sheet pressing portion to press the sheets against the reference surface, wherein a pressing force to press the sheet by the second sheet pressing portion biased by the second biasing member is weaker than a pressing force to press the sheets by the first sheet pressing portion biased by the first biasing member, wherein the first sheet pressing portion comprises an indented portion that forms closely-aligned sheet biasing portions provided on both sides of the indented portion in the sheet feeding direction to press side ends of the sheets, and the indented portion is arranged to face upstream edges of the sheets of the second size in the sheet feeding direction, so that both of the sheet biasing portions and the second sheet pressing portion press the sheets of the first size, and one of the sheet biasing portions at a downstream side of the indented portion and the second sheet pressing portion press the sheets of the second size.

11. The image forming apparatus according to claim 10, wherein the indented portion is provided substantially in the center of the first sheet pressing portion in the sheet feeding direction.

12. The image forming apparatus according to claim 10, wherein the indented portion extends from the lower end of the first sheet pressing portion to a top end of the first sheet pressing portion.

13. The image forming apparatus according to claim 12, wherein the first sheet pressing portion includes an upstream side end pressing portion positioned upstream of the indented portion in the sheet feeding direction and a downstream side end pressing portion positioned downstream of the indented portion in the sheet feeding direction.

14. The image forming apparatus according to claim 13, wherein the upstream side end pressing portion presses the first sized sheets positioned above a predetermined height in the stack but not the first sized sheets positioned below the predetermined height in the stack.

15. The image forming apparatus according to claim 13, wherein the first biasing member applies a force to the upstream side end pressing portion and the second biasing member applies a force to the downstream side end pressing portion.

16. The image forming apparatus according to claim 10, wherein the indented portion extends to a height below a top end of the first sheet pressing portion in the sheet stacking direction.

17. The image forming apparatus according to claim 10, wherein the first sheet pressing portion is provided on the movable side end regulating portion.

18. The image forming apparatus according to claim 10, comprising a sheet stacking portion which is provided on the cassette main body and accommodates the stack of sheets wherein an end of the sheet stacking portion can be raised towards the sheet feeding portion so as to press the stacked sheets against the sheet feeding portion.

* * * * *